US008025484B2

(12) United States Patent
Sun

(10) Patent No.: US 8,025,484 B2
(45) Date of Patent: Sep. 27, 2011

(54) FAN ROTOR ASSEMBLY

(75) Inventor: Han-Chou Sun, Kaohsiung (TW)

(73) Assignee: Profan Technology Corp., Kaohsiung (TW)

( * ) Notice: Subject to any disclaimer, the term of this patent is extended or adjusted under 35 U.S.C. 154(b) by 938 days.

(21) Appl. No.: 12/003,872

(22) Filed: Jan. 3, 2008

(65) Prior Publication Data

US 2009/0175729 A1 Jul. 9, 2009

(51) Int. Cl.
*F04D 29/38* (2006.01)

(52) U.S. Cl. ..... 416/200 R; 416/183; 416/198 R; 416/212 R; 416/235; 416/237

(58) Field of Classification Search ..... 416/200 R, 416/183, 198 R, 212 R, 208, 228, 231 A, 416/235, 237, 248

See application file for complete search history.

(56) References Cited

U.S. PATENT DOCUMENTS

| | | | | |
|---|---|---|---|---|
| 5,611,668 | A * | 3/1997 | Yapp et al. | 416/189 |
| 6,318,964 | B1 * | 11/2001 | Yang | 416/185 |
| 6,572,336 | B2 * | 6/2003 | Horng et al. | 416/183 |
| 6,655,918 | B2 * | 12/2003 | Otsuka | 416/175 |
| 6,832,895 | B2 * | 12/2004 | Yoshioka et al. | 416/183 |
| 7,025,569 | B2 * | 4/2006 | Chang et al. | 416/183 |
| 7,182,572 | B2 * | 2/2007 | Yang | 415/175 |
| 2003/0185682 | A1 * | 10/2003 | Lei et al. | 416/183 |
| 2004/0219022 | A1 * | 11/2004 | Yang | 416/186 R |

* cited by examiner

*Primary Examiner* — Igor Kershteyn
(74) *Attorney, Agent, or Firm* — Posz Law Group, PLC

(57) ABSTRACT

A fan rotor assembly has an inner rotor, an outer rotor, a central retainer and a central shaft. The inner rotor has multiple first blades. The outer rotor is stacked on the inner rotor and has multiple second blades. The central retainer is mounted through the inner and outer retainers. The central shaft is mounted in the central retainer under the inner rotor. The fan rotor assembly with first and second blades provides excellent airflow.

6 Claims, 7 Drawing Sheets

FAN ROTOR ASSEMBLY

BACKGROUND OF THE INVENTION

1. Field of the Invention

The present invention relates to a rotor assembly, and more particularly to a fan rotor assembly having an inner rotor and an outer rotor and each of the inner and outer rotors has multiple blades to provide two sets of blades and therefore to supply excellent airflow.

2. Description of Related Art

Fans are used in electronic devices to dissipate heat from electronic components such as chips inside the electronic devices. A conventional fan rotor of a fan is formed integrally into one piece, is made of plastic by injection molding process and has multiple blades formed radially on the fan rotor. Because the electronic devices are designed more and more compact, fans mounted in the electronic devices have to be sized smaller and smaller with the plastic blades becomes thinner and thinner. However, the thinned plastic blades are too weak and fragile to bear high air pressure and easily snap when the fan rotor rotates.

To overcome the snaps of the thinned plastic blades on the small fan rotor, a metal fan rotor has been developed. The metal fan rotor is made of a metal sheet by stamping the metal sheet and has metal blades. However, the stamping process restricts the a total number of the metal blades formed on the metal fan rotor to be less than that of the plastic blades of the conventional plastic fan rotor. Therefore, the metal fan rotor with less metal blades produces insufficient airflow less than that produced by the plastic fan rotor with more plastic blades. Accordingly, the metal fan rotor has a disappointing heat-dissipating performance.

To overcome the shortcomings, the present invention provides a fan rotor assembly to mitigate or obviate the aforementioned problems.

SUMMARY OF THE INVENTION

The main objective of the invention is to provide a fan rotor assembly having an inner rotor and an outer rotor and each of the inner and outer rotors has multiple blades to provide two sets of blades and therefore to supply excellent airflow.

A fan rotor assembly in accordance with the present invention comprises an inner rotor, an outer rotor, a central retainer and a central shaft. The inner rotor has multiple first blades. The outer rotor is stacked on the inner rotor and has multiple second blades. The central retainer is mounted through the inner and outer retainers. The central shaft is mounted in the central retainer under the inner rotor. The fan rotor assembly with first and second blades provides excellent airflow.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
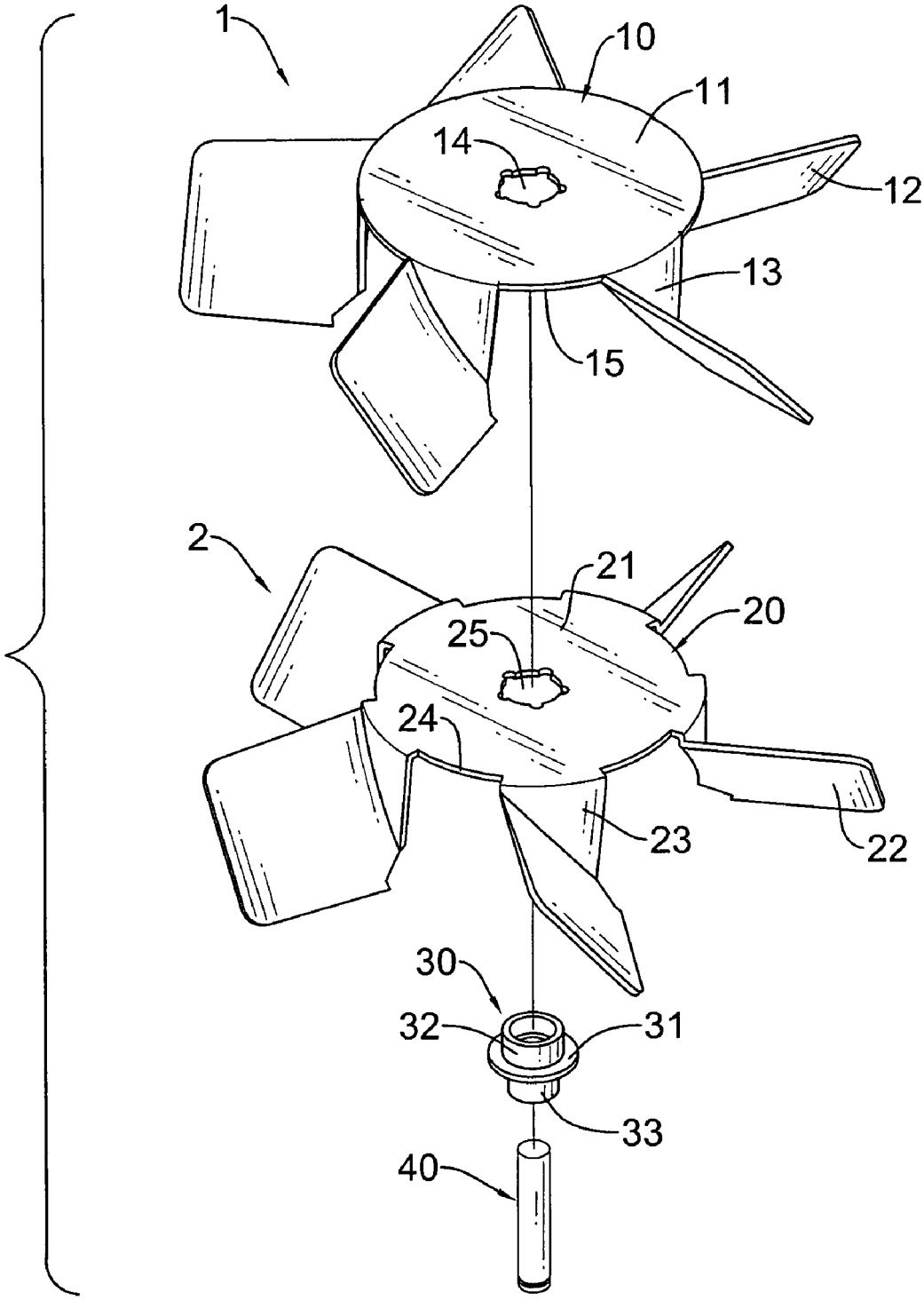
FIG. 1 is an exploded perspective view of a first embodiment of a fan rotor assembly in accordance with the present invention.
Figure 2:
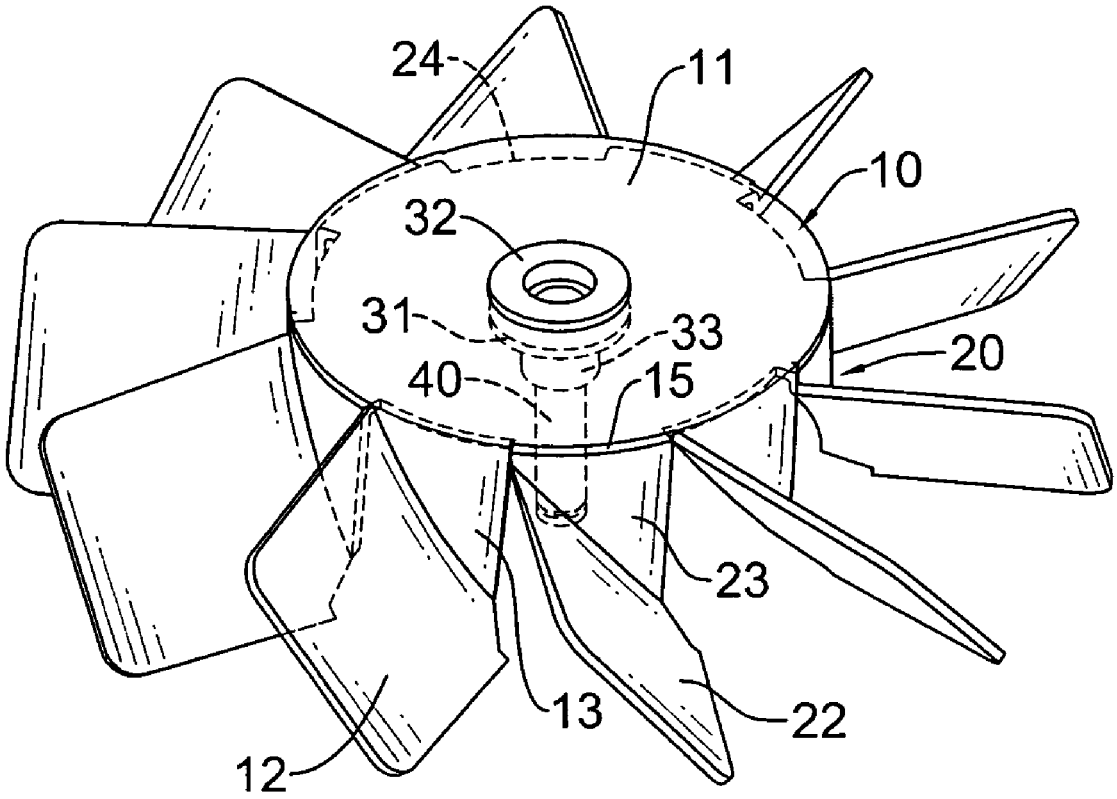
FIG. 2 is a perspective view of the fan rotor assembly in FIG. 1.
Figure 3:
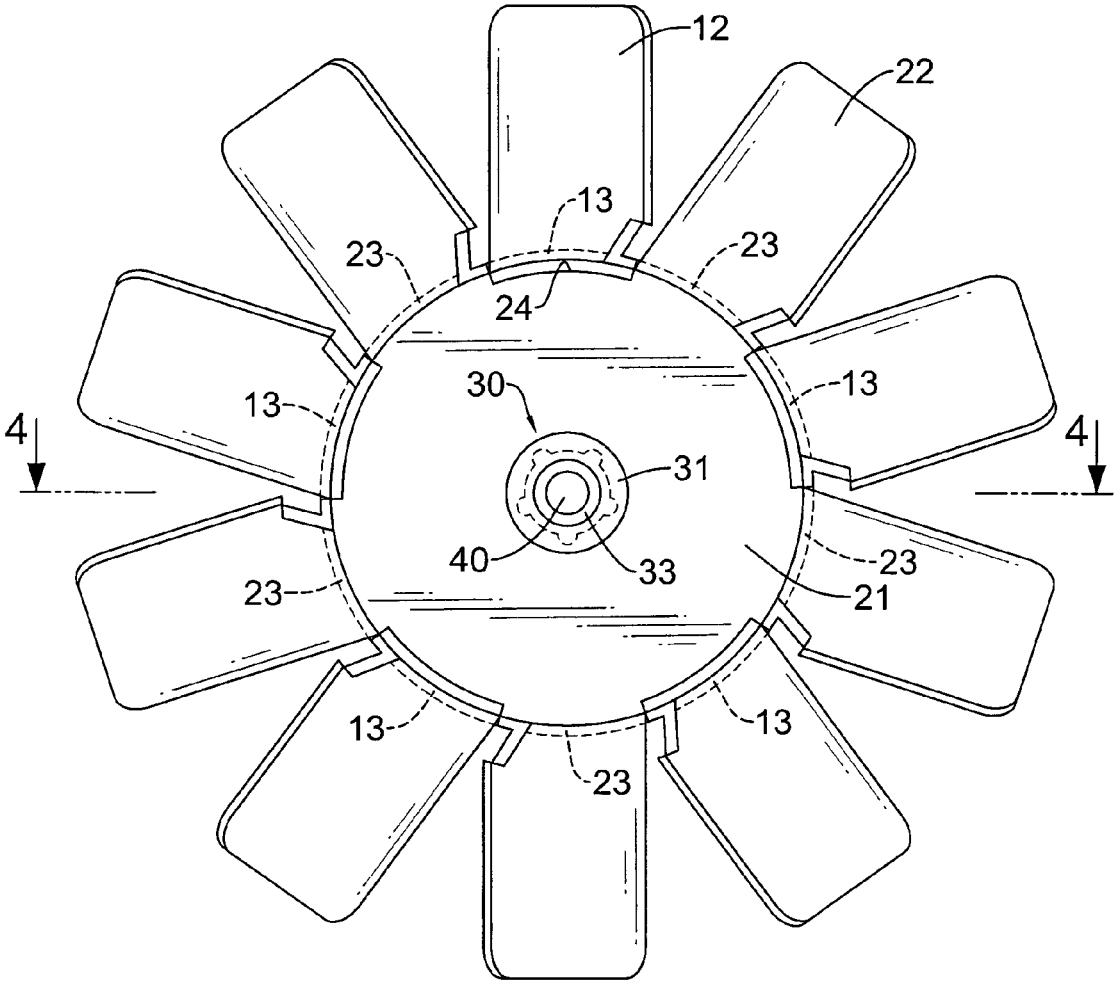
FIG. 3 is a bottom view of the fan rotor assembly in FIG. 2.
Figure 4:
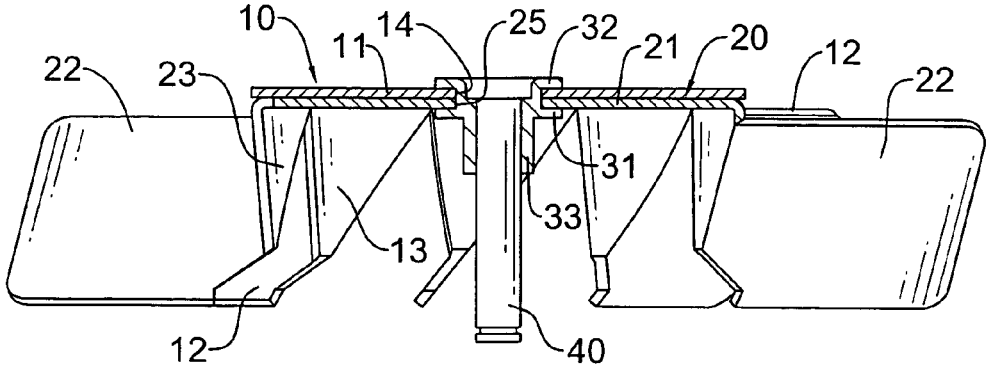
FIG. 4 is a side view in partial section of the fan rotor assembly along line 4-4 in FIG. 3.

With reference to FIGS. 1 to 4, a first embodiment of a fan rotor assembly in accordance with the present invention comprises an inner rotor (20), an outer rotor (10), a central retainer (30) and a central shaft (40).

The inner rotor (20) is formed from a metal sheet (2) by stamping the metal sheet (2), is formed integrally into one piece and has an inner disk (21), multiple first connecting tabs (23), multiple first blades (22) and multiple notches (24).

The inner disk (21) has a diameter, a top surface, a bottom surface, an outer edge and a central hole (25). The outer edge is annular. The central hole (25) is defined through the inner disk (21).

The first connecting tabs (23) are formed on and protrude perpendicularly down from the outer edge at first intervals. Each first connecting tab (23) has an inner surface and may be triangular and have an inclined edge inclined relative to the outer edge.

The first blades (22) correspond respectively the first connecting tabs (23), are formed on and protrude radially outward respectively from the first connecting tabs (23) and may be formed respectively on the inclined edges of the first connecting tabs (23). An included angle between each blade (22) and a corresponding first connecting tab (23) may be a right angle, an acute angle or an obtuse angle.

The notches (24) are defined radially in the outer edge of the inner disk (21), correspond respectively to the first intervals and are located respectively between adjacent first connecting tabs (23).

The outer rotor (10) is formed from a metal sheet (1) by stamping the metal sheet (10), is formed integrally into one piece, is stacked over the inner rotor (20) and has an outer disk (11), multiple second connecting tabs (13) and multiple second blades (12).

The outer disk (11) is mounted on the inner disk (21) and has a diameter, a top surface, a bottom surface, an outer edge and a central hole (15). The diameter of the outer disk (11) is equal to the diameter of the inner disk (21). The bottom surface of the outer disk (11) abuts the top surface of the inner disk (21). The outer edge is annular. The central hole (14) is defined through the outer disk (11).

The second connecting tabs (13) are formed on and protrude perpendicularly down from the outer edge at second intervals (15) and are engaged respectively with the notches (24) in the inner rotor (20) so that the second connecting tabs (13) are flush with and arranged alternately with the first connecting tabs (23). The second intervals (15) are respectively between adjacent second connecting tabs (13) and are engaged respectively with the first connecting tabs (23) of the inner rotor (20). Each second connecting tab (13) has an inner surface and may be triangular and have an inclined edge inclined relative to the outer edge of the outer disk (11).

The second blades (12) correspond respectively to the second connecting tabs (13), are formed on and protrude radially outward respectively from the second connecting tabs (13). With the notches (24) in the inner rotor (20), the second blades (12) are flush with and arranged alternately with the first blades (22) in a same circle. The second blades (12) may be formed respectively on the inclined edge of the second connecting tabs (13). An included angle between each second blade (12) and a corresponding second connecting tab (13) may be a right angle, an acute angle or an obtuse angle.

The central retainer (30) is mounted through the central holes (25, 14) in the inner and outer rotors (20, 10) and may have a tube (33), an inner flange (31) and an outer flange (32).

The tube (33) is mounted through the central holes (25, 14) of the inner and outer rotors (20, 10) to keep the inner and outer rotors (20, 10) concentric and has an open top end and an open bottom end.

The inner flange (31) is annular, is formed on and protrudes radially out from the tube (33) near the open top end and presses tightly against the bottom surface of the inner disk (21) of the inner rotor (20).

The outer flange (32) is annular, is formed on and protrudes radially out from the open top end of the tube (33) and presses tightly against the top surface of the outer disk (11) of the outer rotor (10). The outer flange (32) cooperates with the inner flange (31) to tightly clamp the outer and inner disks (11, 21) together. The outer flange (32) may be formed by riveting or bending the open top end of the tube (33).

The central shaft (40) is mounted in the central retainer (30) under the inner rotor (20) and may be mounted securely in the open bottom end of the tube (33) of the central retainer (30).

Figure 5:
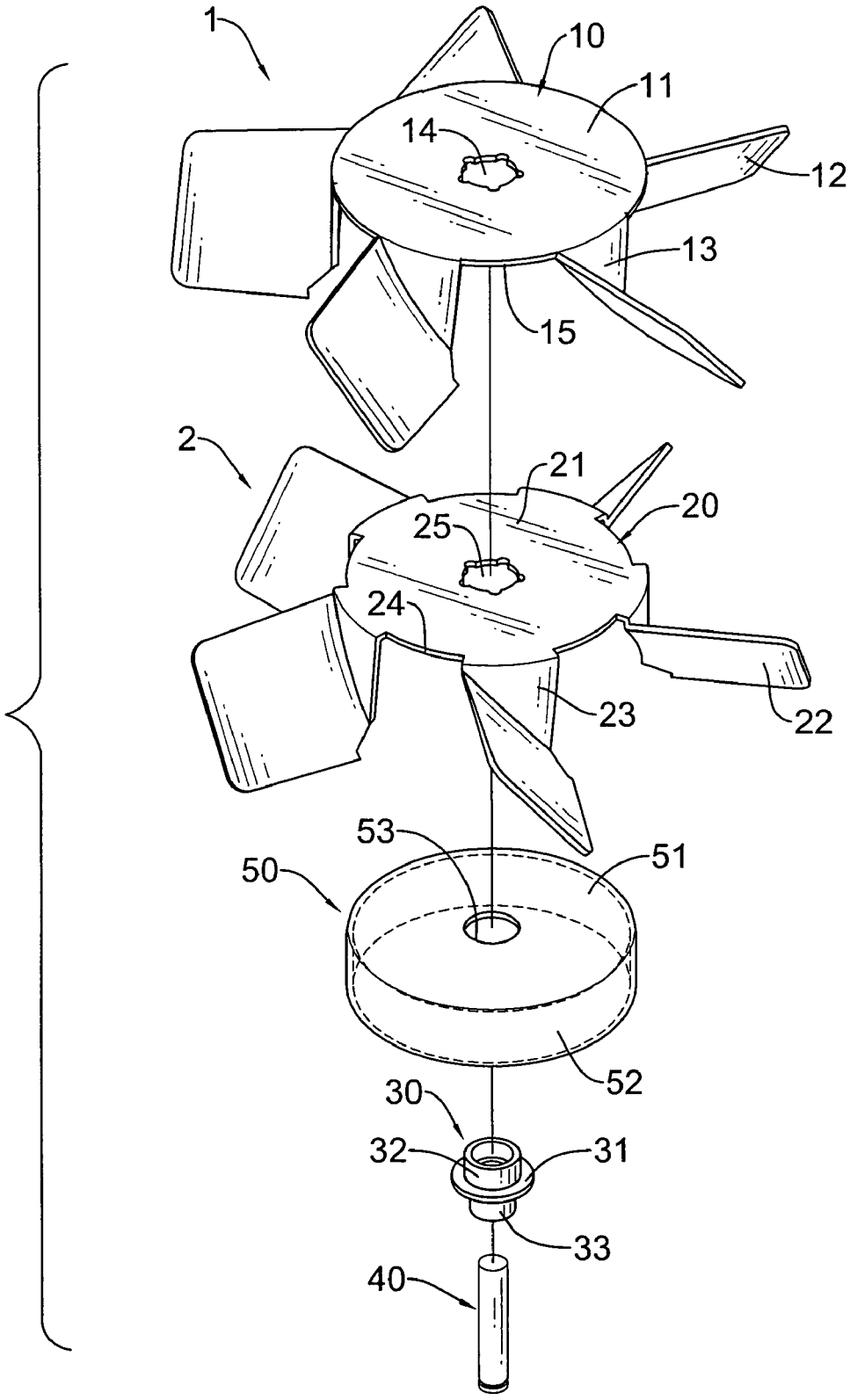
FIG. 5 is an exploded perspective view of a second embodiment of a fan rotor assembly in accordance with the present invention.
Figure 6:
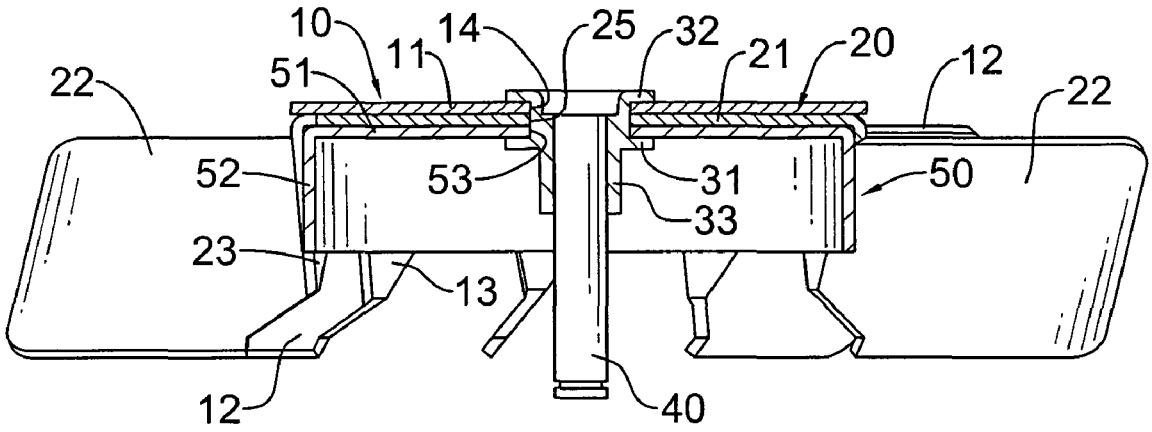
FIG. 6 is a side view in partial section of the fan rotor assembly in FIG. 5.

With further reference to FIGS. 5 and 6, a second embodiment of the fan rotor assembly in accordance with the present invention is similar to the first embodiment and further has a positioning cylinder (50). The positioning cylinder (50) is hollow, is mounted under the inner rotor (20) around the central retainer (30) and has a top board (51), a sidewall (52) and a mounting hole (53).

The top board (51) is mounted around the tube (33) of the central retainer (51) between the inner flange (31) and the outer flange (32) and abuts the bottom surface of the inner disk (21) of the inner rotor (20).

The sidewall (52) is annular and abuts the inner surfaces of the first connecting tabs (23) of the inner rotor (20) and the second connecting tabs (13) of the outer rotor (10). The sidewall (52) prevents relative lateral movements of the inner and outer rotors (20, 10).

The mounting hole (53) is defined through the top board (51) and is mounted around the tube (33) of the central retainer (30) between the inner flange (31) and the outer flange (32).

Figure 7:
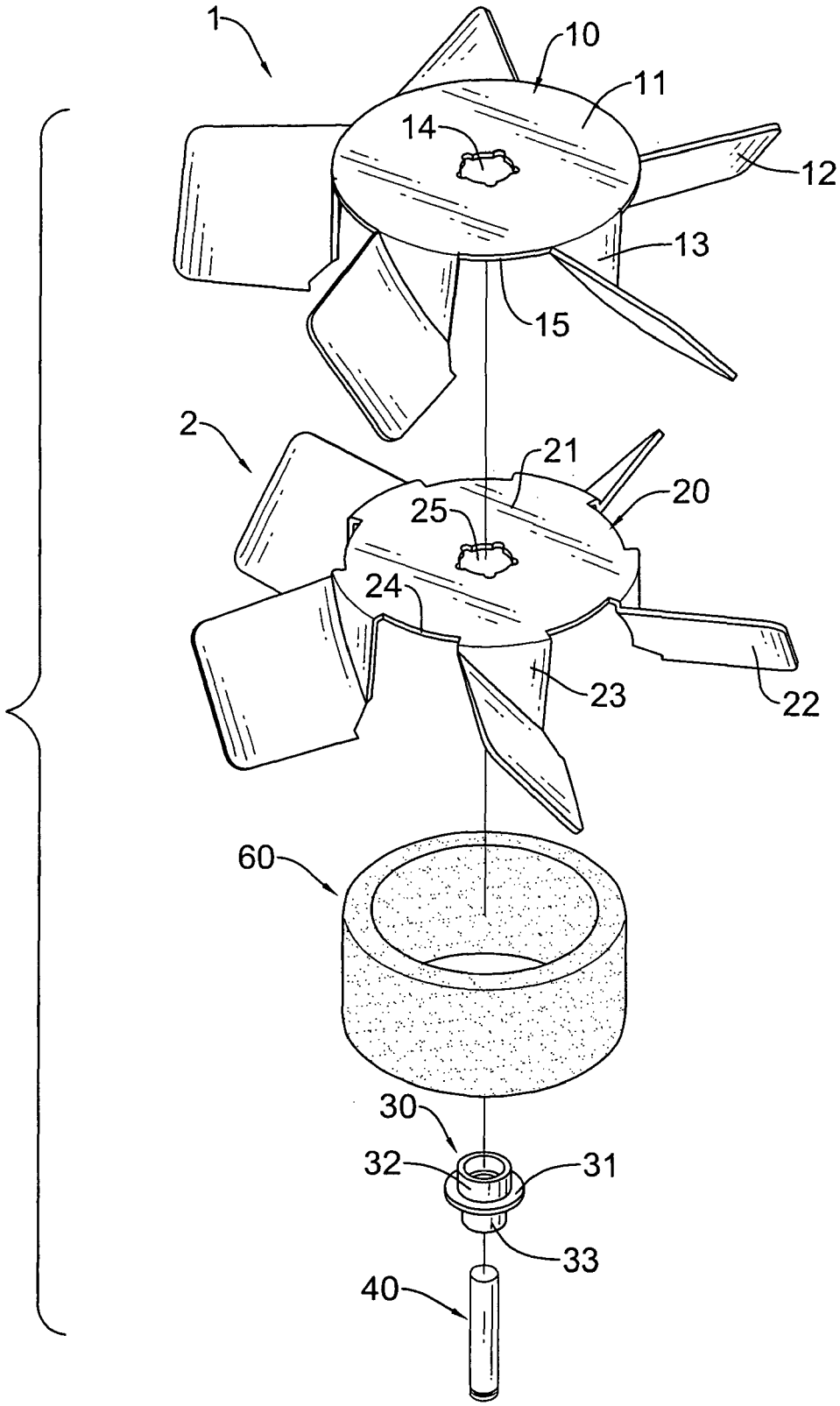
FIG. 7 is an exploded perspective view of a third embodiment of a fan rotor assembly in accordance with the present invention.
Figure 8:
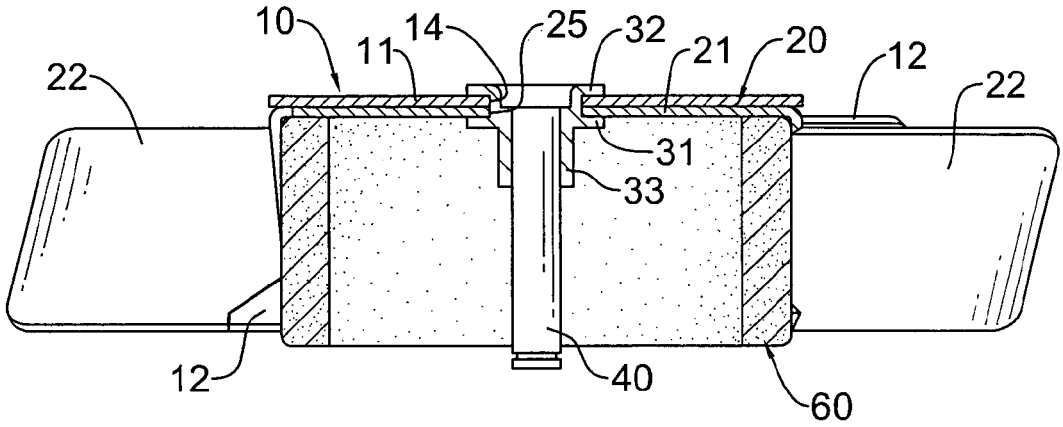
FIG. 8 is a side view in partial section of the fan rotor assembly in FIG. 7.

With further reference to FIGS. 7 and 8, a third embodiment of a fan rotor assembly in accordance with the present invention is similar to the first embodiment and further comprises a magnetic collar (60). The magnetic collar (60) is mounted under inner rotor (20), abuts the bottom surface (21) and the first connecting tabs (23) of the inner rotor (20) and attracts the first and second connecting tabs (23, 13) and the inner and outer disks (21, 11) to securely mount the outer rotor (10) on the inner rotor (20).

The fan rotor assembly with inner and outer rotors (20, 10) is implemented with two sets of blades so that a total number of the blades are double when compared to a conventional metal fan rotor formed from a single metal sheet. Therefore, the fan rotor assembly provides excellent airflow.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fan rotor assembly comprising:

an inner rotor formed from a metal sheet, formed integrally in to one piece and having an inner disk having a diameter, a top surface, a bottom surface, an outer edge being annular and a central hole defined through the inner disk;

multiple first connecting tabs formed and protruding perpendicularly down from the outer edge at first intervals and each first connecting tab having an inner surface;

multiple first blades formed on and protruding outward respectively from the first connecting tabs; and multiple notches defined radially in the outer edge of the inner disk, corresponding respectively to the first intervals and located respectively between adjacent first connecting tabs;

an outer rotor formed from a metal sheet, formed integrally into one piece, stacked over the inner rotor and having an outer disk mounted on the inner disk and having a diameter being equal to the diameter of the inner disk, a top surface, a bottom surface abutting the top surface of the inner disk, an outer edge being annular and a central hole defined through the outer disk;

multiple second connecting tabs formed on and protruding perpendicularly down from the outer at second intervals and engaged respectively with the notches in the inner rotor so that the second connecting tabs are flush with and arranged alternately with the first connecting tabs, and each second connecting tab having an inner surface; and multiple second blades formed on and protruding outward respectively from the second connecting tabs and being flush with and arranged alternately with the first blades in a same circle;

a central retainer mounted through the central holes in the inner and outer rotors; and a central shaft mounted in the central retainer under the inner rotor.

2. The fan rotor assembly as claimed in claim 1, wherein:

the central retainer has a tube mounted through the central holes of the inner and outer rotors and having an open top end and an open bottom end;

an inner flange being annular, formed on and protruding radially out from the tube near the open top end and pressing tightly against the bottom surface of the inner disk; and an outer flange being annular, formed on and protruding radially out from the open top end of the tube and pressing tightly against the top surface of the outer disk; and the central shaft is mounted in the open bottom end of the tube of the central retainer.

3. The fan rotor assembly as claimed in claim 2, wherein each first connecting tab is triangular and having an inclined edge inclined relative to the outer edge, and the first blades are formed respectively on the inclined edges of the first connecting tabs.

4. The fan rotor assembly as claimed in claim 3, wherein each second connecting tab is triangular and having an inclined edge inclined relative to the outer edge of the outer disk, and the second blades are formed respective on the inclined edge of the second connecting tabs.

5. The fan rotor assembly as claimed in claim 4 further comprising a positioning cylinder being hollow, mounted under the inner rotor around the central retainer and having a top board mounted around the tube of the central retainer between the inner flange and the outer flange and abutting the bottom surface of the inner disk of the inner rotor;

a sidewall annular and abutting the inner surfaces of the first connecting tabs of the inner rotor and the second connecting tabs of the outer rotor; and a mounting hole defined through the top board and mounted around the tube of the central retainer between the inner flange and the outer flange.

6. The fan rotor assembly as claimed in claim 4 further comprising a magnetic collar mounted under inner rotor, abutting the bottom surface and the first connecting tabs of the inner rotor and attracting the first and second connecting tabs and the inner and outer disks to securely mount the outer rotor on the inner rotor.

* * * * *